US005099935A

United States Patent [19]

Anthon et al.

[11] Patent Number: 5,099,935

[45] Date of Patent: Mar. 31, 1992

[54] REINFORCED ROTARY DRILL BIT

[75] Inventors: Royce A. Anthon; DeWayne C. Fox, both of West Jordan, Utah

[73] Assignee: Norton Company, Worcester, Mass.

[21] Appl. No.: 607,621

[22] Filed: Oct. 29, 1990

Related U.S. Application Data

[63] Continuation of Ser. No. 149,374, Jan. 28, 1988, abandoned.

[51] Int. Cl.[5] ..... E21B 10/46

[52] U.S. Cl. ..... 175/426; 175/415

[58] Field of Search ..... 175/329, 330, 409, 410, 175/411, 414, 415

[56] References Cited

U.S. PATENT DOCUMENTS

| | | | |
|---|---|---|---|
| 4,350,215 | 9/1982 | Radtke | 175/329 |
| 4,382,477 | 5/1983 | Barr | 175/410 |
| 4,570,725 | 2/1986 | Matthias et al. | 175/329 |
| 4,624,830 | 11/1986 | Barr | 175/329 |
| 4,667,756 | 5/1987 | King et al. | 175/409 |
| 4,714,120 | 12/1987 | King | 175/409 |
| 4,718,505 | 1/1988 | Fuller | 175/329 |

*Primary Examiner*—Terry Lee Melius

*Attorney, Agent, or Firm*—Trask, Britt & Rossa

[57] ABSTRACT

A rotary drill bit for boring earth formations is provided which includes a main body portion of a hard metal matrix material and at least one protrusion or shoulder formed of the same matrix material. On the protrusion is mounted a cutting element. Means for reinforcing the protrusion are provided and extend between the main body portion of the bit and the protrusion. The reinforcements add impact strength to the bit and increase the resistance of the bit to cracking in areas supporting the cutting element.

17 Claims, 2 Drawing Sheets

REINFORCED ROTARY DRILL BIT

This application is a continuation of copending application Ser. No. 07/149,374, filed Jan. 28, 1988, now abandoned.

BACKGROUND OF THE INVENTION

This invention relates to drill bits, and more particularly to rotary drill bits with diamond cutting elements used in the drilling of bore holes in earth formations.

Earth boring diamond drill bits may typically include an integral bit body which may be of steel faced with an abrasion-resistant material such as tungsten carbide or may itself be fabricated of a hard metal matrix material such as tungsten carbide. A plurality of diamond cutting elements are mounted along the exterior face of the bit body. Each diamond cutter typically may be mounted on a stud the other end of which is mounted in a recess in the exterior face of the bit body, or the cutter mount may be integrally cast with the matrix of the bit body.

The cutting elements are positioned along the leading edges of the bit body so that as the bit body is rotated in its intended direction of use, the cutting elements engage and drill the earth formation. In use, tremendous forces are exerted on the cutting elements, particularly against the face thereof in the forward to rear direction as the bit is rotated. Additionally, the bit and cutting elements are subjected to substantial abrasive forces. In some instances, impact, lateral, and/or abrasive forces have caused drill bit failure and cutter loss.

A significant problem encountered when drilling in certain earth formations such as shales, clay, and other water reactive, sticky formations known as "gumbo" has been the tendency of such bits to become clogged during operation. In dealing with such earth formations, bits have been designed with relatively large cutters with strong hydraulics in the proximity of the cutters to remove the cuttings from the cutter faces with a high volume, high velocity, hydraulic fluid flow.

As synthetic diamond technology has advanced, it is now possible to provide large diamond disc cutters up to two inches in diameter for use on bits. These very large cutters have been helpful in drilling in "gumbo" formations. However, the large diameter of the cutting elements has caused problems in providing secure attachment thereof to the exterior face of the rotary drill bits. To accommodate such large diameter cutters, drill bits have been fabricated with outwardly extending shoulders or protrusions on which the cutters may be mounted. However, this leaves a relatively small structure beneath and behind the cutter faces to support the cutters. Additionally, blades, ridges and other structures having multiple cutters mounted thereon and extending significant distances from the main profile of the bit body are also becoming more common, presenting similar problems.

While tungsten carbide or other hard metal matrix bits are highly erosion resistant, such materials are relatively brittle and can crack upon being subjected to the impact forces encountered during drilling. Typically, such cracks have occurred proximate where the cutting element support structures join the matrix body. The shoulders or protrusions on the exterior of the drill bits to accommodate large diameter cutting exposes these areas of the bit to high impact and shear forces. Bits having large cutter elements thereon extending outwardly from the body of the bit are particularly susceptible to cracking and failure due to these high impact and shear forces. If the cutting elements are sheared from the drill bit body, the expensive diamonds on the cutter elements are lost, and the bit may cease to drill.

Accordingly, there is a need in the art for a drill bit having increased impact strength and resistance to cracking, particularly in areas supporting the cutter elements.

SUMMARY OF THE INVENTION

The present invention meets that need by providing a rotary drill bit in which the areas supporting the cutter elements are reinforced to provide those areas with increased impact strength. In accordance with one aspect of the present invention, a rotary drill bit is provided which includes a main body portion of a hard metal matrix material and at least one shoulder or protrusion formed of the same hard metal matrix material. The protrusion is integral with the main body portion of the bit and extends outwardly from the exterior surface of the bit. As used in this specification, the term protrusion encompasses protrusions, shoulders, blades, ridges, or other structures extending outwardly from the main profile of the bit body.

A cutting element is mounted on the protrusion and is angled as known in the art to accomplish drilling of an earth formation. There may be one or a plurality of individual cutter elements mounted on each protrusion. Means for reinforcing the protrusions are provided and extend between the main body portion of the bit and individual protrusions.

In a preferred embodiment, the reinforcing structure comprises a solid preformed arrangement positioned rearwardly of the cutting elements and extending at an acute angle with respect to the main body portion of the bit. The reinforcing structure may be in the form of one or more rods, bars, disks, or wires which are preferably of metal. While steel is the preferred composition for the reinforcing structure, other metals and metal alloys such as stainless steel, nickel alloys or molybdenum may be utilized.

The present invention also encompasses drill bits having a plurality of such protrusions and cutting elements and is particularly suited for use with rotary bits having relatively large diameter cutting elements. The portions of the matrix on which the elements are mounted are reinforced to provide the bit with greater impact strength and greater resistance to cracking and failure of the bit matrix. Accordingly, it is an object of the present invention to provide a rotary drill bit matrix having improved impact strength and resistance to cracking over prior bits. This, and other objects and advantages of the present invention, will become apparent from the following detailed description, the accompanying drawings, and the appended claims.

DESCRIPTION OF THE PREFERRED EMBODIMENTS

Figure 1:
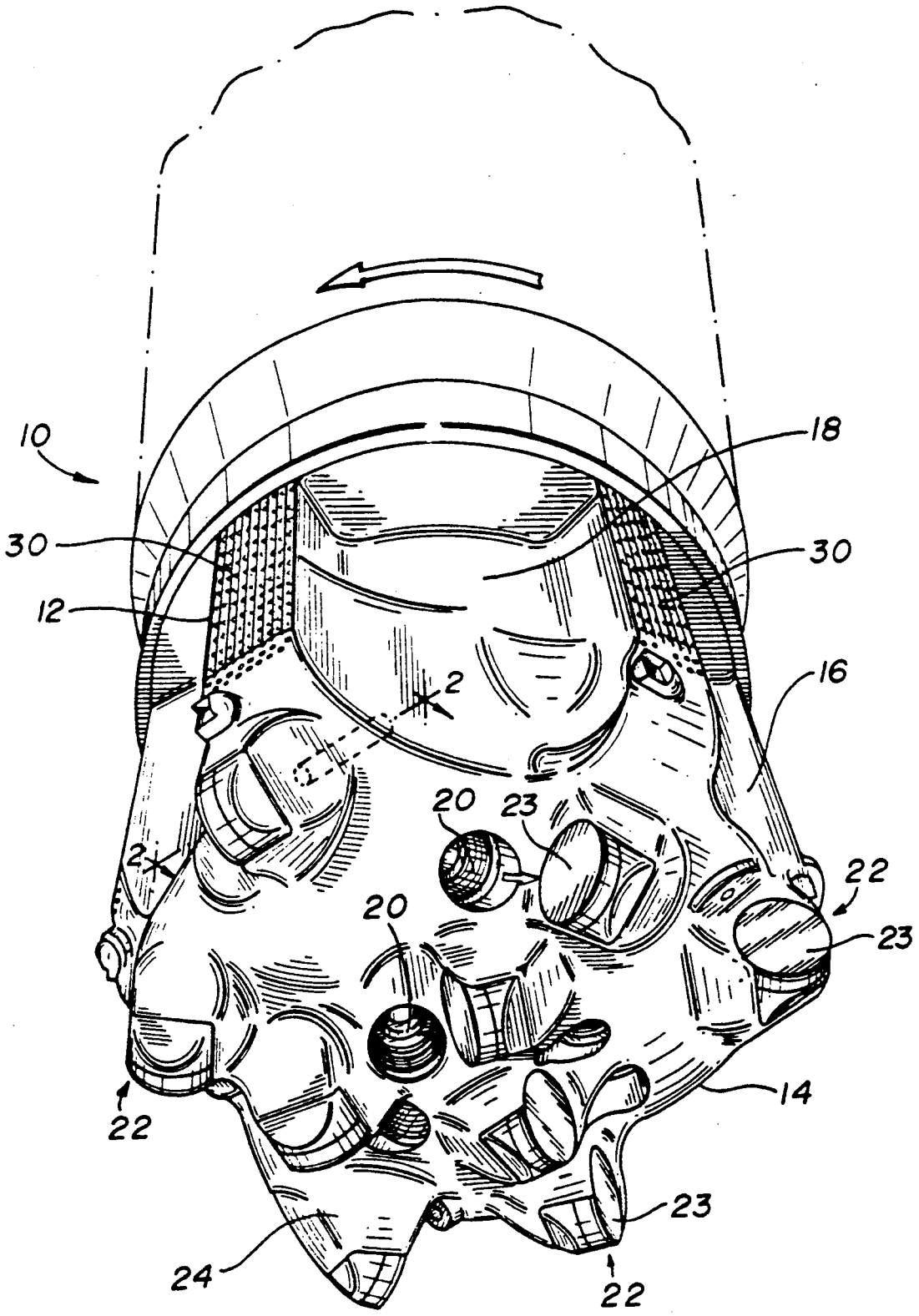
FIG. 1 is a perspective view of the rotary drill bit of the present invention.

The invention is illustrated in the drawings with reference to a typical construction of a rotary earth boring bit. In particular, the invention is illustrated and described with reference to the large compact cutter rotary bit described in greater detail in commonly assigned, copending U.S. application Ser. No. 906,169, filed Sept. 11, 1986. It will also be recognized by those skilled in the art that the configuration of the cutting elements along the exterior face of the matrix may be varied depending upon the desired use of the bit. Thus, the bit may be designed for either a flat, parabolic, or extended blade crown profile. The invention may also be useful in any hard metal matrix bit configuration which has one or more shoulders, ridges, blades, or other protrusions extending outwardly from the main body of the bit.

Referring now to FIG. 1, a rotary drill bit 10 of the type disclosed in the above referenced copending application includes an exterior generally cylindrical surface or gage 12 having a bit face 14 on its lowermost portion. Both gage 12 and bit face 14 are formed of the hard metal matrix material of the bit body, such as tungsten carbide. Defined within gage 12 are a plurality of junk slots 16 and 18. The junk slots are designed to facilitate the upward flow of the drilling fluid and cuttings away from the bit face 14. A number of fluid nozzles 20 are also located on bit face 14. Each of fluid nozzles 20 is designed to provide directed fluid flow to a specific cutting element 22. Each cutting element 22 comprises a tungsten carbide backing 25 having deposited thereon a thin synthetic diamond cutting face 23 which performs the cutting operation.

Cutting elements 22 are mounted on protrusions 24 which extend outwardly from the bit face 14. The cutting elements are secured in place by brazing or otherwise fixing them to the bit face in a conventional manner. For example, cutting elements 22 may be secured to the matrix and to tungsten carbide slug 26 cast into the trailing portion of sockets 28 (best shown in FIG. 2) on bit face 14 by brazing or other suitable means. In a preferred embodiment, the cutting faces 23 of cutting elements 22 are one inch in diameter or larger.

As shown, each cutter element 22 has an associated fluid nozzle 20 which provides a directed hydraulic flow of fluid to the face of the cutting element. This fluid flow applies a force to chips cut from the earth formation, loosening and removing the chips from the faces of the cutting elements. Additionally, bit 10 includes a plurality of gage cutting elements 30 which comprise smaller diameter diamonds which are mounted on the gage 12 of bit face 14. The gage cutters insure that the drill cuts a path of the desired diameter through the earth formation.

Figure 2:
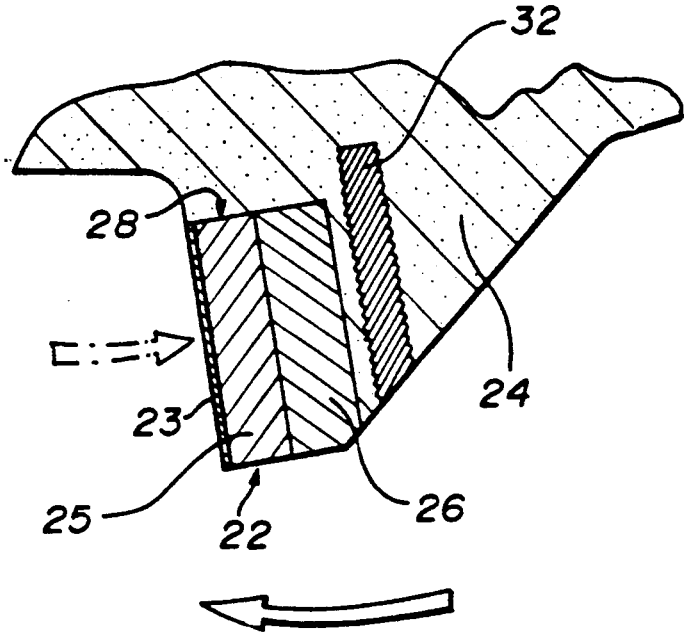
FIG. 2 is a diagrammatic sectional view taken through one of the cutting elements along line 2—2 of FIG. 1 and illustrating the reinforcing structure.

As shown in FIG. 2, positioned rearwardly of each cutting element 22 is reinforcing means 32 extending between the main body portion of drill bit 10 and protrusion or shoulder 24. As illustrated and previously noted, cutting element 22 includes a hard metal matrix backing 25 of tungsten carbide or the like, and is preferably substantially laterally symmetrical.

The backing 25, having cutting face 23 thereon, is brazed into socket 28 in the bit matrix. Backing 25 provides shock protection and load resistance to the cutting face 23. As shown in FIG. 2, the bit 10 rotates in the direction of the arrow and encounters impact forces on cutting face 23 as indicated by the arrow shown in phantom lines. Typically, the cutting element 22 will have a predetermined rake angle to the formation encountered depending upon placement of cutting element 22 and the bit profile and the desired operation of the bit, which depends upon the formations to be drilled.

Reinforcing means 32 may comprise a longitudinally extending element which takes the form of a rod, bar, disk, or wire. It may also comprise a plurality of such structures. In a preferred embodiment, reinforcing means 32 comprises a threaded rod of cylindrical steel stock, such as 1018 or 1020 steel. Preferably, the steel stock has no coatings on it and the stock is cleaned of any oxides prior to being used.

As can be seen, reinforcing means 32 is positioned rearwardly of cutting element 22 and extends between the main body of the bit and substantially the outermost extent of protrusion 24. Reinforcing means 32 is positioned at an acute angle with respect to the centerline of the main body of the bit when referenced with respect to the orientation of the drill string as shown in FIG. 1. At such an angle, the reinforcing means is pointed slightly toward cutting element 22. Reinforcing means 32 also extends at least partially behind cutting element 22 and is also preferably centered with respect to cutting element 22 so that impact forces will be focused thereon.

Figure 3:
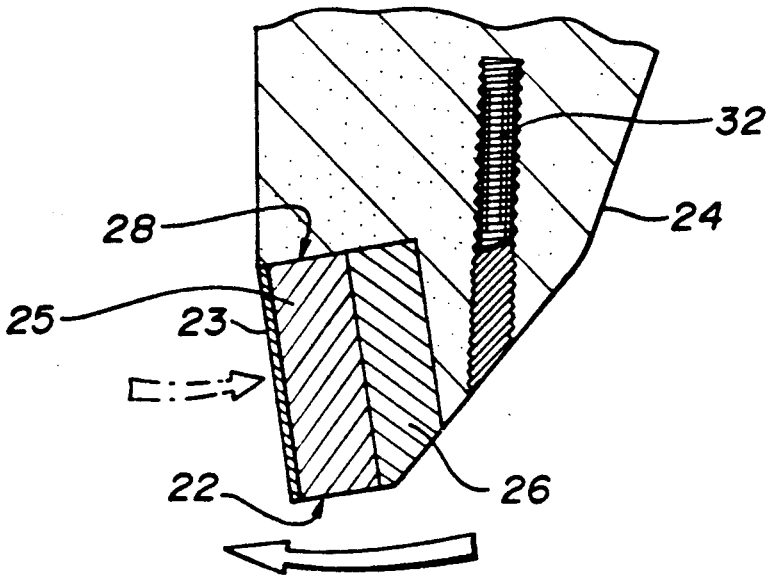
FIG. 3 is also a diagrammatic sectional view similar to FIG. 2 illustrating the reinforcing structure in a bit having a somewhat different structure.

In the embodiment of the invention illustrated in FIG. 3, a somewhat differently configured bit has a protrusion 24, which may be a blade-shaped protrusion emanating from the center of a "fishtail" bit toward the gage of the bit. Cutting element 22 is mounted into socket 28 in the bit matrix. As shown, reinforcing rod 32 is positioned rearwardly of cutting element 22 and extends between the bit matrix and substantially the outermost extent of shoulder or protrusion 34. Reinforcing rod 32 is preferably angled so that it is roughly parallel or at a slight angle (as shown) to the surface of cutting element 22 (as shown). Reinforcing rod 32 is disposed in a substantially perpendicular orientation to the profile of the main body portion of the bit.

Rotary drill bits employing the present invention are generally made by powder metallurgical techniques which are known in the art. The bit is formed in a carbon mold having an internal configuration corresponding generally to the required surface shape of the bit body, including protrusions for mounting cutting elements. Thus, the areas where the junk slots are found on the finished bit body contain carbon or clay displacement material in the mold.

The areas in the mold which correspond to where the cutting elements are to be mounted after furnacing of the bit body are filled with a displacement material such as carbon discs of like size to the cutting elements having clay adjacent thereto so that the furnaced bit body has mounting sockets 28 formed therein. Reinforcing means 32 are positioned in the mold by embedding them in the clay displacement material placed at the outermost extent of the protrusion cavitities from the body mold cavity.

Reinforcing means 32 are positioned rearwardly of where the cutting elements 22 are to be mounted. Preferably, the reinforcing means 32 is a threaded steel rod which is desirable positioned to be perpendicular to the mold profile from which it protrudes. In other words, when viewed from the perspective of the finished bit, reinforcing means 32 extends from the main profile or surface of the bit in a perpendicular manner to the point on the profile from which it extends.

As is conventional, elements which will form the internal fluid passages and nozzles in the finished bit are also positioned in the mold at this time. A steel blank is also positioned in the mold at this time. A hard metal matrix material such as tungsten carbide is then added to the mold. A binder material, preferably a copper-based alloy, in the form of pellets or other small particles, is then poured over the matrix material. The filled mold is then placed in a furnace and heated to above the melting point of the binder, typically above about 1100 degrees C. The molten binder passes through the infiltrates the matrix material.

After cooling, the matrix and binder are consolidated into a solid body which is bonded to the steel blank. After further cooling, the bit body is removed from the mold. The steel blank is then welded or otherwise secured to an upper body or shank. Clay and other displacement material is removed at this time. Because reinforcing means 32 was embedded in the clay, the portion of the reinforcing means which extends from the bit body is machined off flush to the trailing edge of the protrusion.

Cutting elements 22 are then mounted to the bit body. As is conventional, cutting element 22 is mounted into socket 28 and backing 25 secured therein by brazing with a suitable metal brazing material. The gage cutting elements may also be mounted to the exterior of the bit body at this time.

In order that the invention may be more readily understood, reference is made to the following example, which is intended to illustrate the invention, but is not to be taken as limiting the scope thereof.

EXAMPLE

In order to demonstrate the reinforcing capabilities of the structure of the present invention an impact test was made. The test measured the resistance to fracture by impact forces of a matrix material reinforced by a steel rod such as the preferred reinforcing rods of the present invention.

Samples of matrix material were fabricated in a conventional manner by filling a cylindrical mold with tungsten carbide matrix material and a copper-based alloy binder. The mold was sized to produce a sample specimen six inches in length with a ½ inch diameter. The matrices were furnaced at 2150 degrees F. for 60 minutes. Previous testing established that such a sample, when subjected to an impact force with a Charpy Impact Tester, would fracture at an impact force of about 3.5 ftlb.

Sample specimen 1 included a 3/16 inch diameter mild 1018 steel rod positioned centrally within the specimen. Sample specimen 2 included a 3/16 inch diameter threaded mild 1018 steel rod positioned centrally within the specimen. Sample specimen 3 included a ⅛ inch diameter tool steel rod positioned centrally within the specimen. All steel rods were grit blasted prior to placement in the respective mold to remove any oxides.

All sample specimens were then cut in two to form two three inch long bars (labeled A and B below) and tested using a Charpy Impact Tester. The results are reported in Table I below.

TABLE I

| Specimen # | Impact Force | Result |
|---|---|---|
| 1A | 25.0 ftlb | incomplete break |
| 1B | 23.5 ftlb | break |
| 2A | 11.0 ftlb | break |
| 2B | 11.7 ftlb | break |
| 2A | 4.75 ftlb | break |
| 2B | 5.75 ftlb | break |

While certain representative embodiments and details have been shown for purposes of illustrating the invention, it will be apparent to those skilled in the art that various changes in the methods and apparatus disclosed herein may be made without departing from the scope of the invention, which is defined in the appended claims. For example, multiple cutting elements may be mounted on each protrusion; half-circular or other shape cutting elements may be used; several reinforcing elements may be employed for a single protrusion; U or V-shaped reinforcing elements may be used either right side up or upside down; reinforcing elements of a variety of cross-sections, including but not limited to square, rectangular, triangular, elliptical, half-circular, etc., may be employed.

What is claimed is:

1. A rotary drill bit, comprising:

a bit body which includes a main body portion and at least one integral, outwardly extending protrusion thereon of a hard metal matrix material;

at least one cutting element mounted on the leading face of said at least one protrusion; and a solid, preformed structure for reinforcing said at least one protrusion extending outwardly from the hard metal matrix material of the interior of said main body portion at an acute angle to a centerline of said main body portion into the hard metal matrix material of the protrusion to the rear of said at least one cutting element, at least partially therebehind and in spaced relationship thereto.

2. The rotary drill bit of claim 1 in which said solid preformed structure is a rod, bar, disk, or wire.

3. The rotary drill bit of claim 2 in which said preformed structure is positioned at an acute angle with respect to said main body portion of said bit body.

4. The rotary drill bit of claim 1 in which said preformed structure is fabricated from steel.

5. The rotary drill bit of claim 1 in which said preformed structure is of cylindrical steel stock.

6. The rotary drill bit of claim 5 in which said cylindrical steel stock is threaded.

7. The rotary drill bit of claim 1 in which said reinforcing structure comprises a longitudinally extending element disposed in substantially perpendicular orientation to the profile of said main body portion.

8. The rotary drill bit of claim 1 in which said reinforcing structure extend to substantially the outermost portions of said protrusions.

9. The rotary drill bit of claim 1 in which said at least one protrusion supports a single, substantially laterally symmetrical cutting element, and said reinforcing structure comprises a rodlike element centered with respect to and to the rear of said cutting element.

10. A rotary drill bit, comprising:

a bit body which includes a main body portion and at least one integral protrusion extending outwardly therefrom, said main body portion and protrusion being formed of a hard matrix material;

at least one cutting element mounted on the leading face of said protrusion; and a solid, preformed structure for reinforcing said at least one protrusion extending from the interior of said main body portion outwardly at an acute angle with respect to a centerline thereof into said protrusion in rearwardly spaced relationship to said at least one cutting element and at least partially therebehind.

11. The rotary drill bit of claim 10 in which said reinforcing structure comprises a longitudinally extending element disposed in substantially perpendicular orientation to the profile of said main body portion.

12. The rotary drill bit of claim 10 in which said reinforcing structure extends to substantially the outermost portion of said protrusion.

13. The rotary drill bit of claim 10 in which said protrusion supports a single, substantially laterally symmetrical cutting element, and said reinforcing structure comprises a rodlike element centered with respect to and to the rear of said cutting element.

14. The rotary drill bit of claim 10 in which said solid preformed structure is a rod, bar, disk, or wire.

15. The rotary drill bit of claim 14 in which said preformed structure is fabricated from steel.

16. The rotary drill bit of claim 14 in which said preformed structure is of threaded cylindrical steel stock.

17. The rotary drill bit of claim 14 in which said preformed structure is positioned at an acute angle with respect to said main body portion.

* * * * *